US006086442A

United States Patent [19]

Sandhu et al.

[11] Patent Number: 6,086,442

[45] Date of Patent: Jul. 11, 2000

[54] METHOD OF FORMING FIELD EMISSION DEVICES

[75] Inventors: Gurtej S. Sandhu; Sujit Sharan, both of Boise, Id.

[73] Assignee: Micron Technology, Inc., Boise, Id.

[21] Appl. No.: 09/259,231

[22] Filed: Mar. 1, 1999

[51] Int. Cl.[7] ..... H01J 9/02

[52] U.S. Cl. ..... 445/24; 445/58

[58] Field of Search ..... 445/24, 50, 58

[56] References Cited

U.S. PATENT DOCUMENTS

| | | | |
|---|---|---|---|
| 5,186,670 | 2/1993 | Doan et al. | 445/50 |
| 5,378,182 | 1/1995 | Liu | 445/50 |
| 5,401,676 | 3/1995 | Lee | 445/50 |
| 5,789,272 | 8/1998 | Wang et al. | 438/20 |
| 5,817,201 | 10/1998 | Greschner et al. | 445/50 |

OTHER PUBLICATIONS

Bouteville, A., et al., "$TiSi_2$ Selective Growth in a Rapid Thermal Low Pressure Chemical Vapor Deposition System", *J. Electrochem. Soc.,* vol. 139, No. 8, pp. 2260–3 (Aug. 1992).

Chi, Eung Joon., et al., "Electrical Characteristics of Metal Silicide Field Emitters", 9th International Vacuum Microelectronics Conference, St. Petersburg, pp. 188–191 (1996).

Morimoto, Yukihiro, et al., "Analysis of Gas Release form Vitreous Silica", *Journal of Non–Crystalline Solids,* (North–Holland), No. 139, pp. 35–46 (1992).

Nakamoto, Masayuki, et al., "Low Operation Voltage Field Emitter Arrays Using Low Work Function Materials Fabricated by Transfer Mold Technique", *IEEE,* IDEM 96–297, pp. 297–300 (1996).

U.S. application No. 09/130,634, John Lee et al., filed Aug. 6, 1998.

*Primary Examiner*—Kenneth J. Ramsey

*Attorney, Agent, or Firm*—Wells, St.John, Roberts, Gregory & Matkin P.S.

[57] ABSTRACT

The invention comprises methods of forming field emission devices. In but one implementation, a method of forming a field emission device includes forming an electron emission substrate comprising emitters and an electrically conductive extraction grid formed outwardly of the emitters. The extraction grid is supported and spaced from the emitters by an insulative mass. An electrically conductive layer is substantially selectively deposited over the grid and emitters relative to the insulative mass. After the depositing, the electron emission substrate is joined with an electron collector substrate. In one implementation, a method of forming a field emission device includes depositing an electrically conductive layer over the grid and emitters, with the depositing forming the electrically conductive layer over at least some exposed surfaces of the insulative mass. The conductive layer is etched away from the insulative mass while leaving at least a portion of the conductive layer remaining over outermost portions of the emitters. After the etching, the electron emission substrate is joined with an electron collector substrate. In one implementation, an electrically conductive layer is deposited over the grid and emitters. Only a portion of the electrically conductive layer is etched away from the grid and emitters after the depositing. After the etching, the electron emission substrate is joined with an electron collector substrate.

40 Claims, 2 Drawing Sheets

METHOD OF FORMING FIELD EMISSION DEVICES

TECHNICAL FIELD

This invention relates to field emission devices and to methods of forming field emission devices.

BACKGROUND OF THE INVENTION

Field emission displays are one type of field emission device, and are utilized in a variety of display applications. Conventional field emission displays include a cathode plate having a series of emitter tips fabricated thereon. The tips are configured to emit electrons toward a phosphor screen to produce an image. The emitters arc typically formed from an emitter material such as conductive polysilicon, molybdenum, or aluminum. Multiple emitters are typically utilized to excite a single pixel. For example, 120 emitters might be used for a single pixel. Individual pixels of color displays contain a deposited one of red, green, or blue phosphor.

The ease or ability with which emitter tips emit electrons is impacted by a number of factors, including a property known as the work function of the material. Other parameters remaining constant, the lower the work function of the material from which the emitters are made, the greater the electron emissivity of the emitter. This typically translates in an ability to use lower voltages and currents to drive the emitters.

SUMMARY OF THE INVENTION

The invention comprises methods of forming field emission devices. In but one implementation, a method of forming a field emission device includes forming an electron emission substrate comprising emitters and an electrically conductive extraction grid formed outwardly of the emitters. The extraction grid is supported and spaced from the emitters by an insulative mass. An electrically conductive layer is substantially selectively deposited over the grid and emitters relative to the insulative mass. After the depositing, the electron emission substrate is joined with an electron collector substrate. In one implementation, a method of forming a field emission device includes depositing an electrically conductive layer over the grid and emitters, with the depositing forming the electrically conductive layer over at least some exposed surfaces of the insulative mass. The conductive layer is etched away from the insulative mass while leaving at least a portion of the conductive layer remaining over outermost portions of the emitters. After the etching, the electron emission substrate is joined with an electron collector substrate. In one implementation, an electrically conductive layer is deposited over the grid and emitters. Only a portion of the electrically conductive layer is etched away from the grid and emitters after the depositing. After the etching, the electron emission substrate is joined with an electron collector substrate.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
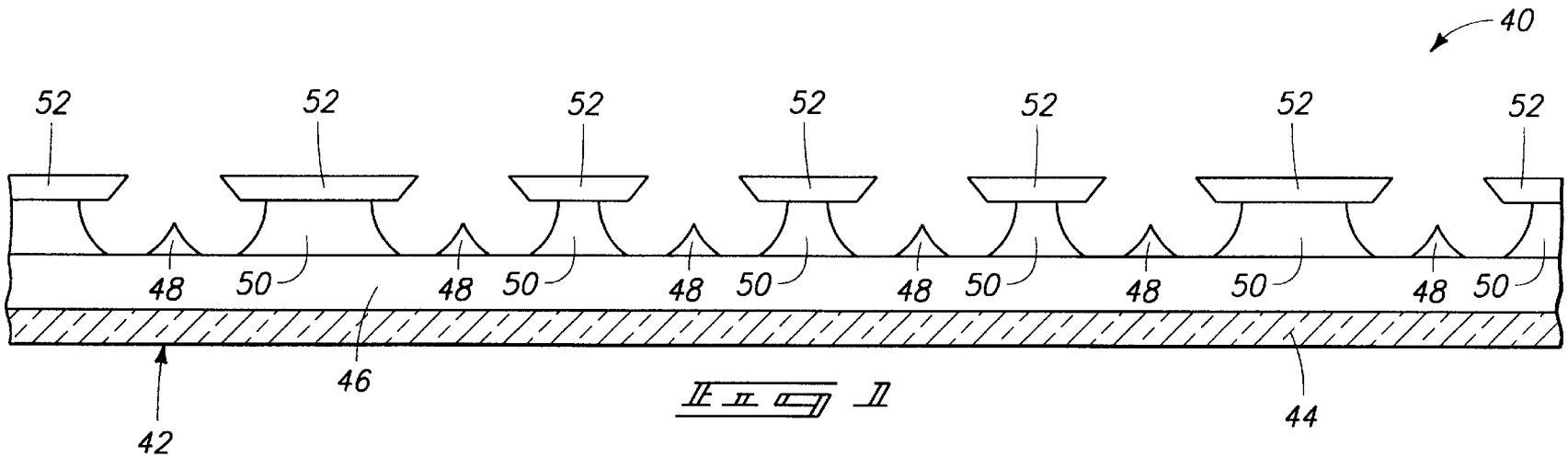
FIG. 1 is a diagrammatic sectional view of an example field emission device substrate in process in accordance with one aspect of the invention.

FIG. 1 illustrates a field emission device in the form of field emission display 40 in fabrication. In the depicted example, an electron emitter or emission substrate 42 has been formed and comprises a glass plate 44 having a first semiconductive material 46 (or other conductive material) formed/patterned thereover. Semiconductive material 46 might, for example, comprise either a p-type doped or an n-type doped semiconductive material such as, for example, monocrystalline silicon or polycrystalline silicon. Emitters 48 are provided in electrical connection with layer 46, and preferably comprise semiconductive material, for example, doped polycrystalline or monocrystalline silicon. An electrically conductive extraction grid 52 is formed outwardly of emitters 48, being supported and spaced from such emitters by an insulative layer or mass 50. An exemplary material for layer 50 comprises borophosphosilicate glass. Example materials for layer 52 include conductively doped polysilicon, metal or metal compound materials.

Figure 2:
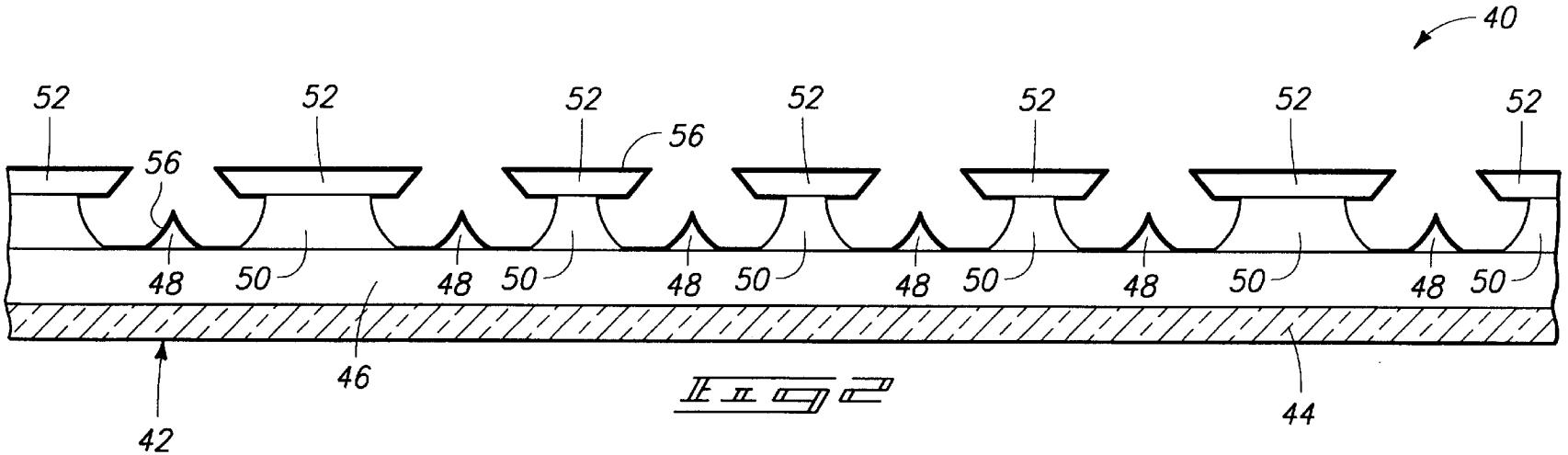
FIG. 2 is a view of the FIG. 1 device at a processing step subsequent to that shown by FIG. 1.

Referring to FIG. 2, an electrically conductive layer 52 is substantially selectively deposited over grid 52 and emitters 48 relative to insulative mass 50. In the context of this document, the term "substantially selective" is defined by a deposition ratio from one region to another of at least 2:1 in thickness. Such substantially selective depositing might be conducted with or without plasma depending upon the material being deposited and possibly impacted by the degree of selectivity which might be obtained as determined by whether plasma is or is not used. The preferred method of substantial selectively depositing is by chemical vapor deposition (CVD), which includes plasma enhanced chemical vapor deposition (PECVD) and low pressure chemical vapor deposition (LPCVD). Preferred materials for electrically conductive layer 52 are elemental metals or metal alloys, and metal compounds. A preferred and reduction to practice metal includes elemental titanium. One example class of preferred metal compounds in accordance with the invention include metal suicides, with titanium silicide being but one example. Conductive metal nitrides are but one other example class of compounds, including hybrids of these or other classes such as metal nitride suicides.

One more specific preferred process for achieving the selective deposition of FIG. 2 comprises forming a plasma from source gases comprising a metal tetrahalide (i.e., $TiCl_4$) and $H_2$. Argon or other gases might also be present. An example power range for the deposition using a parallel plate single wafer plasma reactor is from 100 W to 800 W. Preferred pressure for the deposition is from 0.5 Torr to 20 Torr. A preferred volumetric ratio range of flow of metal tetrahalide to $H_2$ to the reactor is from 300 sccm:1000 sccm to 150 sccm:8000 sccm. When wafer temperature during the depositing over silicon containing emitter tips is below 500° C., the material will deposited largely as elemental metal from the metal tetrahalide. For example where $TiCl_4$ is utilized, the deposition over the emitter tips and the extraction grid will be elemental titanium. Where the deposition temperature is greater than 500° C. and the deposition is occurring on silicon containing material, the deposited electrically conductive material 56 will largely comprise a metal silicide which is formed in situ during the depositing from reaction of deposited metal and the silicon material of the emitter and/or extraction grid. An example and preferred thickness range for layer 56 is from about 50 Angstroms to about 1000 Angstroms.

Whether an elemental, alloy or metal compound layer is formed, it would be possible at this point in the process to nitridize metal layer 56 to transform at least the outer portions thereof into a metal nitride (not specifically shown). An example process for conducting such would be to expose the substrate to a nitrogen atom containing plasma. A preferred example includes a mixture of hydrogen and nitrogen which is ideally void of any separate titanium component (i.e., void of $TiCl_4$). A preferred specific example plasma treatment is to utilize hydrogen in the form of $H_2$ gas and nitrogen in the form of $N_2$ gas at a volumetric flow ratio to a plasma enhanced chemical vapor deposition reactor of $N_2$ to $H_2$ of from about 1:1 to about 4:1. Sub-atmospheric pressure of from 1 Torr to 10 Torr and a temperature of greater than or equal to about 600° C. are also preferred. An example RF plasma power is 250 W for a single wafer reactor. Alternately or in addition thereto, the hydrogen and nitrogen provided for such preferred treatment can be from a single molecular gas, such as $NH_3$.

Another example preferred method of substantially selectively depositing layer 56 (where such comprises a metal silicide) constitutes LPCVD at a temperature of at least 650° C. comprising metal tetrahalide and silicon comprising source gases. An example preferred metal tetrahalide is $TiCl_4$. Preferred silicon source gases include both organic and inorganic silicon source gases. Example inorganic source gases include silane, disilane, etc. An example organic silicon source gas comprises methyl silane. $H_2$, Ar, and other gases are also of course possible components. In this particular described process, the substantially selective deposition is preferably not plasma enhanced, which facilitates or enhances the selectivity to the extraction grid and emitters to the exclusion of the insulative mass. A preferred temperature range for the selective deposition is from 650° C. to 900° C., with a preferred pressure range being from 10 mTorr to 1 Torr. A specific example is at 775° C. and 200 mTorr. A specific example involving silane and $TiCl_4$ flows includes feeding pure $TiCl_4$ and a mixture of 10% by volume silane in a helium carrier gas. A preferred range of flow ratios of such gases of the silane mixture and $TiCl_4$ is from 20:1 to 100:1 by volume, thus providing a ratio of the silicon comprising compound silane in a ratio of from 2:1 to 10:1 by volume as compared to $TiCl_4$. A preferred specific example is a 5:1 ratio.

Most preferably, the substantially selective depositing forms essentially none of the conductive layer on the insulative mass. For example, selective deposition ratios in excess of 1000:1 have been demonstrated utilizing $TiCl_4$ and silane as described above where in essence no shorting conductive stringers are formed between that portion of layer 56 overlying the extraction grid and that portion overlying the emitters, meaning essentially none of the conductive layer was formed on the insulative mass. Yet, the invention does contemplate less selective depositions whereby the electrically conductive layer is deposited over at least some exposed surfaces of the insulative mass possibly effective to at least initially create a fatal emitter-to-grid short. Further in accordance with an aspect of the invention, nonselective depositions of an electrically conductive layer over both the grid and the emitters are contemplated.

To contend with such eventualities or the possibility thereof, the invention contemplates etching of any conductive layer material away from the insulative mass, the goal being to effectively eliminate any shorts which might be present while leaving at least a portion of the conductive layer remaining over outermost portions of the emitters. Further, at least a portion of the conductive layer is also preferably left remaining over the extraction grid. Example etchings include both wet and dry etchings. Removal of any conductive layer material from over the insulative mass while leaving at least some of the same over the emitters is most easily facilitated where the thickness of the deposited layer is greater over the emitters than over the insulative mass. In such instances, a timed isotropic etch is preferably conducted of sufficient length to remove all of the material from over the mass but not all of the material from over the emitters. A surface passivation treatment in the form of the above described nitridation process might be conducted after such an etch.

An example wet etching process includes a quick strip in a 300 parts by volume of water to one part by volume of a 50% by volume HF solution (in water) at a temperature of 25° C. Were nitridation to be conducted as described above, it would be preferred to do the strip prior to the nitridation as HF may not be sufficiently effective in stripping nitride material. If the nitridation were done first and then the stripping, a wet etching chemistry would most likely have to be changed, for example, to include a combination of ammonium hydroxide and hydrogen peroxide. A nitridation step could follow this if a Ti N surface is desired.

An alternate preferred processing for doing a strip comprises dry etching. For example, a chlorine containing gas, such as $Cl_2$ or a compound containing chlorine (i.e., HCl) can be fed into a chamber within which the substrate is received to conduct a quick timed etch to etch away any titanium or TiN that may be extending between the grid and emitters along the insulative mass. A preferred process is to deposit the electrically conductive layer by a chemical vapor deposition process with or without plasma, with the etching comprising dry etching of the deposited layer in an effort to remove conductive stringers in the same chamber without removing the substrate from the chamber between the depositing and the etching. After such etching, treatment to nitridize the surface to form TiN is preferred.

Figure 3:
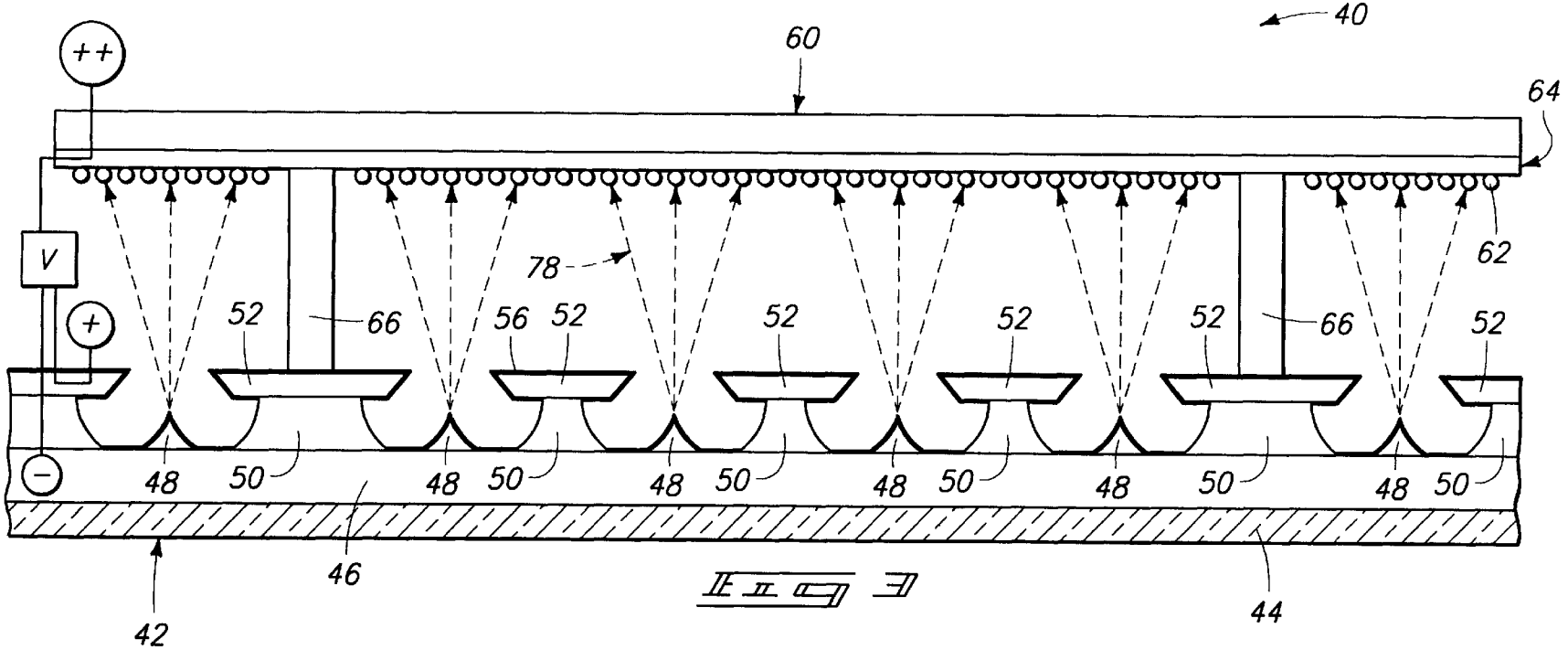
FIG. 3 is a schematic, sectional view of one embodiment of a field emission display incorporating the example FIG. 2 substrate.

Referring to FIG. 3, electron emission substrate 42 is joined with an electron collector substrate 60. Such is shown in the form of a transparent face plate comprising phosphors 62 formed on a luminescent screen 64. Spacers 66 separate and support electron collector substrate 60 relative to electron emission substrate 42. Electron emission 78 from emitters 48 causes phosphors 62 to luminesce and a display to be visual through face plate 60. Techniques for forming field emission displays are described in U.S. Pat. Nos. 5,151,061; 5,186,670; and 5,210,472, hereby expressly incorporated by reference herein.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of forming a field emission device comprising:

forming an electron emission substrate comprising emitters and an electrically conductive extraction grid formed outwardly of the emitters, the extraction grid being supported and spaced from the emitters by an insulative mass;

substantially selectively chemical vapor depositing an electrically conductive layer over the grid and emitters relative to the insulative mass; and after the depositing, joining the electron emission substrate with an electron collector substrate.

2. The method of claim 1 wherein the substantially selective depositing comprises PECVD.

3. The method of claim 1 wherein the substantially selective depositing comprises PECVD, and the electrically conductive layer comprises an elemental metal or metal alloy.

4. The method of claim 1 wherein the emitters comprise silicon, the substantially selective depositing comprises PECVD, and the electrically conductive layer comprises a metal silicide formed in situ during the depositing from reaction of deposited metal and silicon material of the emitter.

5. The method of claim 1 wherein the substantially selective depositing is not plasma enhanced.

6. The method of claim 1 wherein the electrically conductive layer comprises a metal silicide, and the substantially selective depositing comprises LPCVD at a temperature of at least 650° C. comprising metal tetrahalide and silicon comprising source gases.

7. The method of claim 6 wherein the silicon comprising source gas comprises a silane.

8. The method of claim 6 wherein the silicon comprising source gas comprises an organic silicon compound.

9. The method of claim 6 wherein the silicon comprising source gas comprises a silicon compound present in at least a 2:1 ratio by volume as compared to the metal tetrahalide.

10. The method of claim 9 wherein the ratio is no greater than 10:1.

11. The method of claim 1 wherein the electrically conductive layer comprises an elemental metal or metal alloy.

12. The method of claim 1 wherein the electrically conductive layer comprises elemental titanium.

13. The method of claim 1 wherein the electrically conductive layer comprises a metal compound.

14. The method of claim 1 wherein the electrically conductive layer comprises a metal silicide.

15. The method of claim 1 further comprising after the depositing and before the joining, etching only a portion of the electrically conductive layer from the emitters.

16. The method of claim 1 further comprising after the depositing and before the joining, etching only a portion of the electrically conductive layer from the extraction grid.

17. The method of claim 16 further comprising after the depositing and before the joining, etching only a portion of the electrically conductive layer from the emitters.

18. The method of claim 16 further comprising nitridizing the electrically conductive layer after the etching and prior to the joining.

19. The method of claim 1 wherein the substantially selective depositing forms the electrically conductive layer over at least some exposed surfaces of the insulative mass, and further comprising after the depositing and before the joining, etching the conductive layer away from the insulative mass.

20. The method of claim 1 wherein the substantially selective depositing forms none of the conductive layer on the insulative mass.

21. The method of claim 1 further comprising nitridizing the electrically conductive layer prior to the joining.

22. A method of forming a field emission device comprising:

forming an electron emission substrate comprising emitters and an electrically conductive extraction grid formed outwardly of the emitters, the extraction grid being supported and spaced from the emitters by an insulative mass;

depositing an electrically conductive layer over the grid and emitters;

etching only a portion of the electrically conductive layer away from the grid and emitters after the depositing; and after the etching, joining the electron emission substrate with an electron collector substrate.

23. The method of claim 22 wherein the etching comprises wet etching.

24. The method of claim 22 wherein the etching comprises dry etching.

25. The method of claim 22 wherein the depositing comprises CVD in a chamber, and the etching comprises dry etching in the chamber without removing the substrate from the chamber between the depositing and the etching.

26. The method of claim 22 further comprising nitridizing the electrically conductive layer after the etching and prior to the joining.

27. A method of forming a field emission device comprising:

forming an electron emission substrate comprising emitters and an electrically conductive extraction grid formed outwardly of the emitters, the extraction grid being supported and spaced from the emitters by an insulative mass;

depositing an electrically conductive layer over the grid and emitters, the depositing forming the electrically conductive layer over at least some exposed surfaces of the insulative mass;

etching the conductive layer away from the insulative mass while leaving at least a portion of the conductive layer remaining over outermost portions of the emitters; and after the etching, joining the electron emission substrate with an electron collector substrate.

28. The method of claim 27 further comprising nitridizing the electrically conductive layer after the etching and prior to the joining.

29. The method of claim 27 wherein the etching leaves at least a portion of the conductive layer remaining over the extraction grid.

30. The method of claim 27 wherein the etching comprises wet etching.

31. The method of claim 27 wherein the etching comprises dry etching.

32. The method of claim 27 wherein the depositing comprises CVD in a chamber, and the etching comprises dry etching in the chamber without removing the substrate from the chamber between the depositing and the etching.

33. The method of claim 32 wherein the depositing comprises PECVD.

34. The method of claim 32 wherein the etching leaves at least a portion of the conductive layer remaining over the extraction grid.

35. The method of claim 27 wherein the electrically conductive layer comprises an elemental metal or metal alloy.

36. The method of claim 27 wherein the electrically conductive layer comprises elemental titanium.

37. The method of claim 27 wherein the electrically conductive layer comprises a metal compound.

38. The method of claim 27 wherein the electrically conductive layer comprises a metal silicide.

39. The method of claim 27 further comprising nitridizing the conductive layer after the depositing and before the etching.

40. The method of claim 27 further comprising nitridizing the conductive layer after the etching.

* * * * *

UNITED STATES PATENT AND TRADEMARK OFFICE

CERTIFICATE OF CORRECTION

PATENT NO : 6,086,442

DATED : July 11, 2000

INVENTOR(S) : Gurtej S. Sandhu and Sujit Sharan

It is certified that error appears in the above-identified patent and that said Letters Patent are hereby corrected as shown below:

Col. 1, line 15
replace "arc"
with --are--.

Col. 2, line 48
replace "suicides"
with --silicides--.

Col. 2, line 51
replace "suicides"
with --silicides--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*